US008474504B2

(12) United States Patent
Vulpitta

(10) Patent No.: US 8,474,504 B2
(45) Date of Patent: Jul. 2, 2013

(54) TAPE DISPENSER

(75) Inventor: Brian A. Vulpitta, Avon Lake, OH (US)

(73) Assignee: Shurtech Brands, LLC, Avon, OH (US)

( * ) Notice: Subject to any disclaimer, the term of this patent is extended or adjusted under 35 U.S.C. 154(b) by 134 days.

(21) Appl. No.: 12/832,503

(22) Filed: Jul. 8, 2010

(65) Prior Publication Data

US 2012/0006497 A1 Jan. 12, 2012

(51) Int. Cl.

| | |
|---|---|
| ***B65B 51/06*** | (2006.01) |
| ***B29C 65/00*** | (2006.01) |
| ***E04D 15/00*** | (2006.01) |
| ***B32B 37/00*** | (2006.01) |
| ***B26F 3/02*** | (2006.01) |

(52) U.S. Cl.

USPC ..... 156/577; 156/527; 156/510; 156/523; 156/486; 156/579; 225/39; 225/46; 225/65; 225/56; 225/66; 225/47

(58) Field of Classification Search

USPC .... 156/510, 527, 523, 486, 577, 579; 225/39, 225/46, 65, 56, 66, 47

See application file for complete search history.

(56) References Cited

U.S. PATENT DOCUMENTS

| | | | | | |
|---|---|---|---|---|---|
| 1,837,180 | A | * | 12/1931 | Bennett, Jr. et al. | 225/9 |
| 2,295,477 | A | * | 9/1942 | Jackson | 225/26 |
| 2,670,041 | A | * | 2/1954 | Krueger | 225/20 |
| D209,356 | S | * | 11/1967 | Merle | D19/69 |
| 4,884,734 | A | * | 12/1989 | Kahl et al. | 225/26 |
| 4,961,525 | A | * | 10/1990 | Corbo et al. | 225/65 |
| 5,642,866 | A | * | 7/1997 | Nieding | 242/588.4 |
| 5,820,005 | A | | 10/1998 | Perkitny et al. | |
| D432,573 | S | * | 10/2000 | Gratz | D19/69 |
| D432,575 | S | * | 10/2000 | Van Den Berg | D19/69 |
| 7,021,356 | B2 | | 4/2006 | Kelders et al. | |
| D573,645 | S | * | 7/2008 | Sommers et al. | D19/69 |
| D580,497 | S | | 11/2008 | Dureiko et al. | |
| D588,646 | S | * | 3/2009 | Vulpitta | D19/69 |
| D591,354 | S | | 4/2009 | Vulpitta | |
| 7,669,631 | B2 | | 3/2010 | Bailey et al. | |
| 2009/0179061 | A1 | | 7/2009 | Dureiko et al. | |
| 2010/0018653 | A1 | | 1/2010 | Dureiko et al. | |
| 2010/0084450 | A1 | | 4/2010 | Vulpitta | |

* cited by examiner

*Primary Examiner* — Philip Tucker
*Assistant Examiner* — Alex Efta
(74) *Attorney, Agent, or Firm* — Fay Sharpe LLP

(57) ABSTRACT

A tape dispenser is provided with a roller adjacent its cutter and tape retaining tabs adjacent the roller. The tabs a close to the roller and hold the end of the tape adjacent the roller facilitating application of the tape to a substrate. The dispenser is also provided with feet at its rear end allowing the dispenser to rest on its rear end with the end of the tape remote from the supporting surface.

4 Claims, 4 Drawing Sheets

TAPE DISPENSER

This disclosure relates in general to hand-held tape dispensers for adhesive tape such as packaging tape or the like.

BACKGROUND

Packaging tape is often sold as rolls of tape and sometimes sold as rolls of tape upon a dispenser. Packaging tape is often about two inches wide and is sold in rolls having a length measured in tens of yards or meters. Some packaging tape is sold on rolls of 20 yards or less. Some packaging tape is sold in lengths of about 30-50 yards. Packaging tapes are also sold in rolls containing 100 yards or more. Packaging tape for use by consumers in the home or in office settings are frequently sold in the 20-60 yard or meter range. Those sizes are of primary concern in the present disclosure.

Packaging tape is comprised of a plastic film of uniform width having an adhesive disposed on one side of the film. The film may have a release agent on the other side of the film allowing the tape to be wound upon a core in many layers forming a finished roll. The core can be plastic or cardboard and normally has a smooth cylindrical inner surface.

Packaging tapes are often used by consumers in an inexpensive dispenser. Some dispensers are disposable, single use dispensers, sold with the roll of tape and adapted to be used once and discarded. Other dispensers are still inexpensive but are designed to be reusable by the consumer. Such dispenser allow a consumer to buy a roll of tape on the dispenser in a multipack with other rolls of tape or to buy the single roll of tape and thereafter buy unmounted rolls of tape at less cost than a roll of tape on a dispenser.

Packaging tape dispensers for use by consumers at home and in small business situations and offices need to be inexpensive, compact, easy to use, easy to store, and durable. Tape dispensers should protect the exposed end of the roll of tape from contact with unintended surfaces. Tape dispensers should make the initial application of tape to a substrate easy. Tape dispensers should prevent the free end of tape from falling back on the roll. Dispensers attempting to meet all of these needs have been available in the past. Such dispensers often take the form of an injection molded body with a metal cutting blade at the forward end. The bodies consist of two side walls which are generally parallel to one another and an interconnecting wall connecting the forward ends to the side walls to one another. Inwardly extending hub portions are provided on each of the side walls. A roll of tape is supported on the two hub portions between the two side walls and below the interconnecting wall. The leading end of the tape on the roll of tape is pulled away from the roll of tape and led over tape retaining tabs, one on each side wall. The leading end of the tape is led past the cutter and applied to the substrate to which it is to be fixed. An appropriate length is applied and the cutter is used to cut off the piece of tape. The new end of tape is hopefully retained upon the tape retaining tabs and the tape dispenser can be set aside until it is next needed. Tape dispensers generally as described are available for tape on three inch cores and 1½ inch cores. Such dispensers are available in many different configurations attempting to meet the various needs described above and others. Existing tape dispensers do not completely and consistently fill all consumer needs.

SUMMARY OF THE DISCLOSURE

The present disclosure contemplates a new and improved tape dispenser which addresses the above-identified problems and goals and others and provides a tape dispenser which has the abilities needed to dispense adhesive tape wound upon cores and which is easily stored when not in use and easily starts a piece of tape by one handed application.

In accordance with an aspect of the application, a tape dispenser is provided having two side walls, each side wall having a hub structure, a forward end, a rearward end and a foot adjacent the rearward end; an interconnecting portion connecting the forward ends of the two side walls together; a cutter extending between the two side walls adjacent the interconnecting portion; a roller extending between the side walls adjacent the cutter; the side wall feet adapted to support the tape dispenser in a rest position on its rear end with the cutter located at the upward end of the resting dispenser, and the roll adjacent cutter disposed directly above the footprint of the dispenser feet.

In accordance with another aspect of the disclosure, the dispenser has tape retaining tabs, one extending inwardly from each side wall, and the top surface of the tape retaining tabs are relatively close to the bottom surface of the roller and the cutter.

Yet further in accordance with the disclosure, a plane passing through the axis of a roll of tape mounted on the dispenser and the cutter forms an angle of about 12° or less with a plane passing through the axis of the roll of tape and the top surface of the tape dispensing tabs.

Yet further in accordance with the disclosure, the angle between these two planes is about 8-12 degrees.

Still further in accordance with the disclosure, the angle between the two planes is about 10°.

It is an object of the present disclosure to provide a tape dispenser which is inexpensive to manufacture, easy to use, consumes little plastic material, and can be used one handed.

It is a further object of the present disclosure to provide a tape dispenser which securely retains the leading end of a roll of tape adjacent a roller and tape retaining tabs when in the rest position.

It is another object of the present disclosure to provide a tape dispenser having a supported rest position on feet at the rear whereby the leading end of the tape to be dispensed is held a considerable distance from the supporting surface and thereby unlikely to foul or adhere to unintended surfaces.

It is still another object of the present disclosure to provide a tape dispenser which positions the leading end of the tape to be dispensed adjacent a pressure roller whereby a user may apply the leading end of the tape to an intended substrate in a one-handed operation holding the tape dispenser and tape in one hand and the substrate in the other.

It is yet another object of the present disclosure to provide a tape dispenser which is easy to use, easy to store, easy to refill with a roll of tape and inexpensive.

Further objects and advantages of the disclosure will be apparent from the following detailed description of a preferred embodiment taken together with the accompanying drawings.

DETAILED DESCRIPTION

The description and drawings herein are merely illustrative of the disclosure and various modifications, changes and alterations can be made in the structures disclosed without departing from the scope of the disclosure.

Referring now to the figures, a tape dispenser 10 with a roll of tape 12 mounted on the tape dispenser 10 is disclosed. The roll of tape 12 is conventional in all respects. It comprises a tape core 14 with a body of adhesive tape 16 wound about the tape core. The tape core 14 is conventionally paper board, cardboard, or plastic. Tape cores are nominally known by their approximate inside diameter. Frequently, encountered tape core sizes include three inch tape cores and 1½ inch tape cores. The drawings present a three inch tape core. However, other tape core diameters are usable in the invention. The body of pressure sensitive adhesive tape 16 wound upon the core 14 can have different characteristics for different applications. The tape can be transparent or translucent or opaque. The tape can have an aggressive, permanent adhesive or a less aggressive adhesive depending upon intended use. The tape can be of various width, however, for packaging tape widths of 1.88 inches or 2 inches are conventional. The tape can have various lengths. Tape rolls of 20-50 yards or 20-50 meters are often encountered. However, shorter and longer are also available to consumers.

This disclosure is primarily concerned with packaging tape and dispensers for using packaging tape in the home or office setting. Other, similar tapes used in similar environments may also be subject to this disclosure. This disclosure is not concerned with high volume industrial packaging as seen at manufacturing facilities, mail order merchants or the like wherein expensive, heavier professional equipment will be used.

Figure 7:
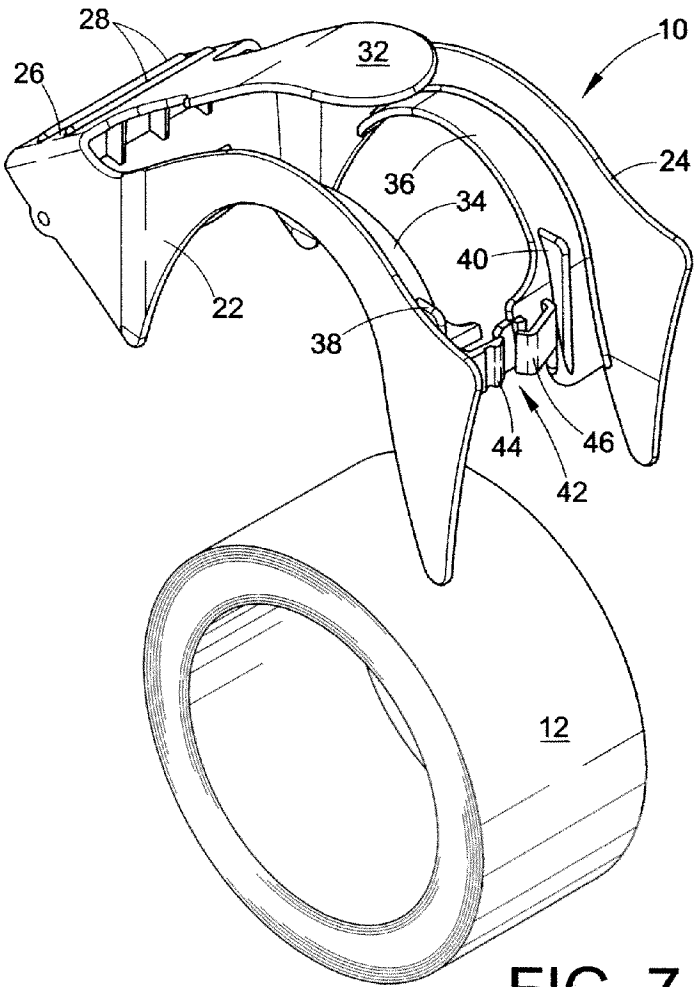
Figure 6:
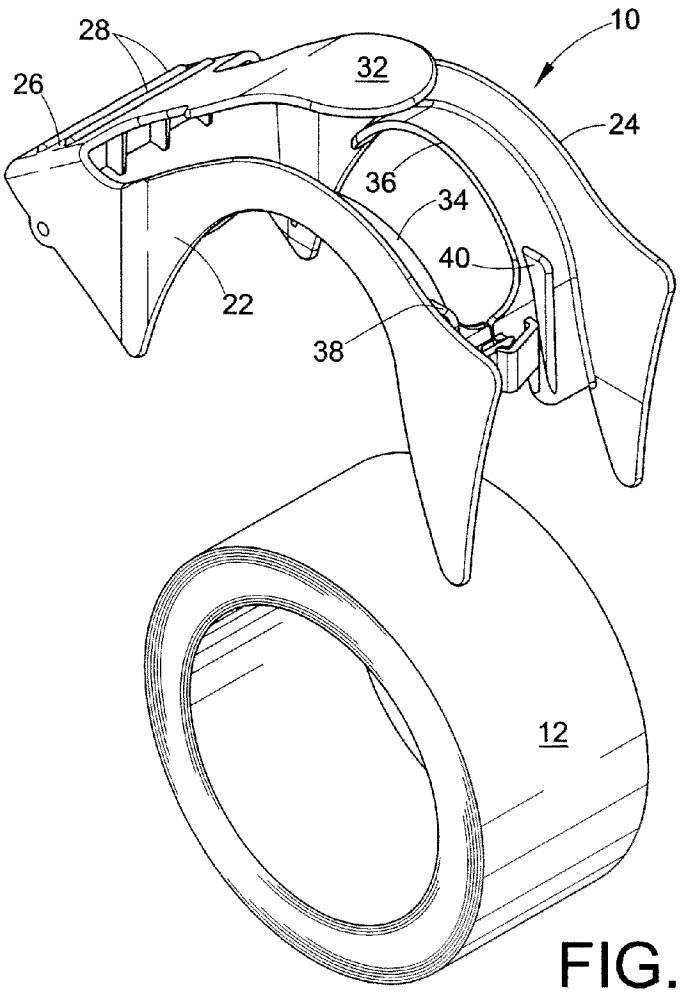
FIG. 6 is a rear perspective of the dispenser separated from the roll of tape with the hub connectors engaged; and, FIG. 7 is a view similar to FIG. 6 with the hub connectors disengaged.

With reference to FIGS. 6 and 7, the tape dispenser 10 has (when viewed from the front) a right sidewall 22, a left sidewall 24 and a an interconnecting portion 26. The right sidewall 22 and the left sidewall 24 are generally mirror images of one another with the exception of the hub connector means holding the rearward portions of the sidewalls together.

A directional convention will be used in this description for ease of presentation. The portion of the dispenser 10 adjacent the cutter where tape is dispensed will be called the forward portion or forward end of the dispenser. The portion or end of the dispenser remote from the cutter will be called the rearward end of the dispenser. The portion of the dispenser adjacent the interconnecting portion and extending rearwardly from there will be referred to as the top of the dispenser. The portions of the dispenser opposite the top and opposite the interconnecting portion will be referred to as the bottom or the lower portion of the dispenser. This is so even though this is not the preferred method of disposing the dispenser when it is set down. It is done for convenience in description.

Figure 1:
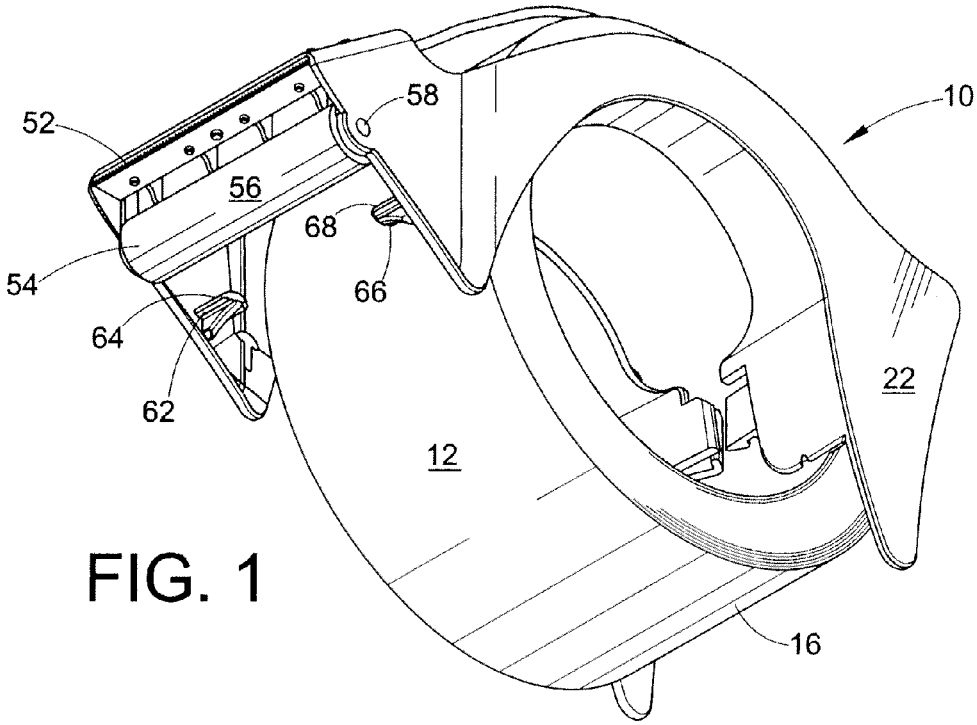
FIG. 1 is perspective view showing a tape dispenser in accordance with the disclosure with the roll of tape mounted on the tape dispenser.
Figure 3:
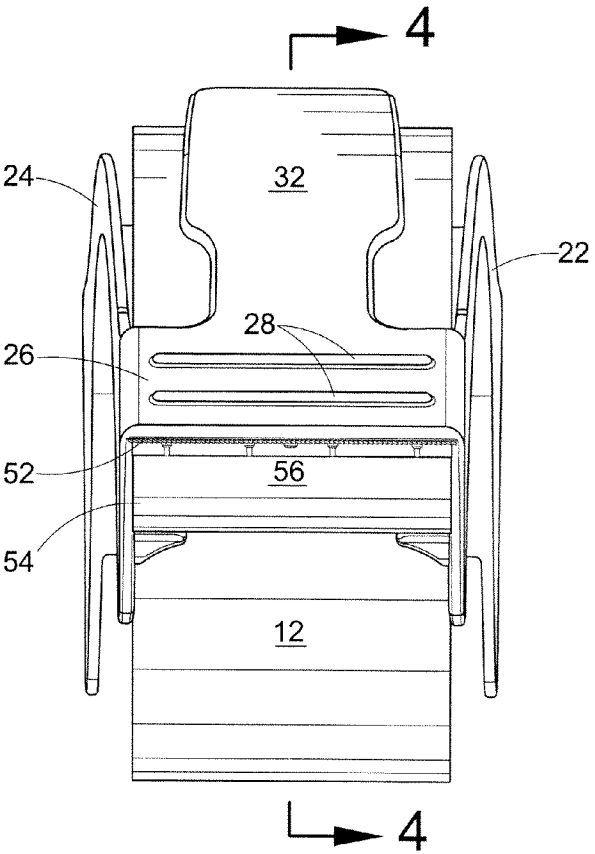
FIG. 3 is a front view of the tape dispenser seen in FIGS. 1 and 2.

Referring to FIGS. 1 and 3, the interconnecting portion 26 is integral with the top forward edge of the right sidewall 22 and the left sidewall 24. Two ridges 28 extend across the forward portion of the interconnecting portion 26 over most of its width. A tongue 32 extends rearwardly from the interconnecting portion 26. The tongue has a straight portion and a curved portion and is sized and contoured to overlay and not engage the top of a roll of tape 12 when the roll of tape is mounted on the dispenser. The tongue 32 is flexible and resilient. It can be pressed down into engagement with the roll of tape by a user if so desired.

Referring to FIG. 6, a curved right hub 34 extends from the right sidewall 22 inwardly, that is toward the left sidewall 24. A curved left hub 36 extends inwardly from the left sidewall 24. A right hub fin 38 extends from the rear portion of the right curved hub 34. A left hub fin 40 extends from the rear portion of the left curved hub 36. These four structures, taken together, rotatably support a roll of tape 12 on the dispenser when the dispenser is closed. The curved hub portions 34, 36 are not completely circular in shape. Rather, the forward portions are circular with a radius of curvature appropriate for the size tape core being supported. The rear portions of curved hubs 34, 36 curve inwardly at a smaller radius of curvature and then end in flatter sections supporting a hub locking mechanism 42. The hub locking mechanism 42 consists of a prong 44 with an enlarged head. The prong 44 extends from the right sidewall 22 toward the left sidewall 24.

The left sidewall 24 supports a portion of the curved hub 36 extending toward the prong 44. A resilient catch 46 overlays the rear portion of the left curved hub 36. The resilient catch 46 includes a portion extending parallel to the hub surface at this point and a portion extending perpendicular to the hub portion. The prong 44 can enter into the space between the left curved hub 36 and the resilient catch 46. In this position, the enlarged head of the prong 44 is held by the resilient catch 46 and the dispenser is locked in the closed position seen FIG. 6. If one wishes to open the dispenser to insert a new roll of tape, one pulls the rear portion of the right sidewall 22 from the rear portion of the left sidewall 24 which pulls the prong 44 away from the catch 46 opening the dispenser.

Referring to FIG. 1, a cutter 52 is fixed to the forward edge of the interconnecting portion 26. The cutter 52 in this embodiment is a metal strip with a serrated forward edge fixed to the plastic interconnecting portion 26 by means of posts passing through polls in the metal cutter 52. This mechanism of fixing cutters to dispensers is conventional. Alternatively, serrated teeth can be molded into the leading edge of the interconnecting portion 26 dispensing with the metal cutter. However, a metal cutter is preferred for certain kinds of tape.

A roller 54 is disposed below the cutter 52. The roller 54 consists of a central cylindrical segment 56 and short coaxial cylindrical posts 58 extending from the ends of the central cylindrical segment 56. The posts 58 have a diameter considerably smaller than the central cylindrical segment 56. The posts 58 are received in circular holes in the right sidewall 22 and the left sidewall 24 thus rotatably supporting the roller 54 under the cutter 52.

A left side tape retaining tab 62 with an upper surface 64 extends inwardly from the left sidewall 24. A right side tape retaining tab 66 with an upper surface 68 extends inwardly from the right sidewall 22.

Figure 5:
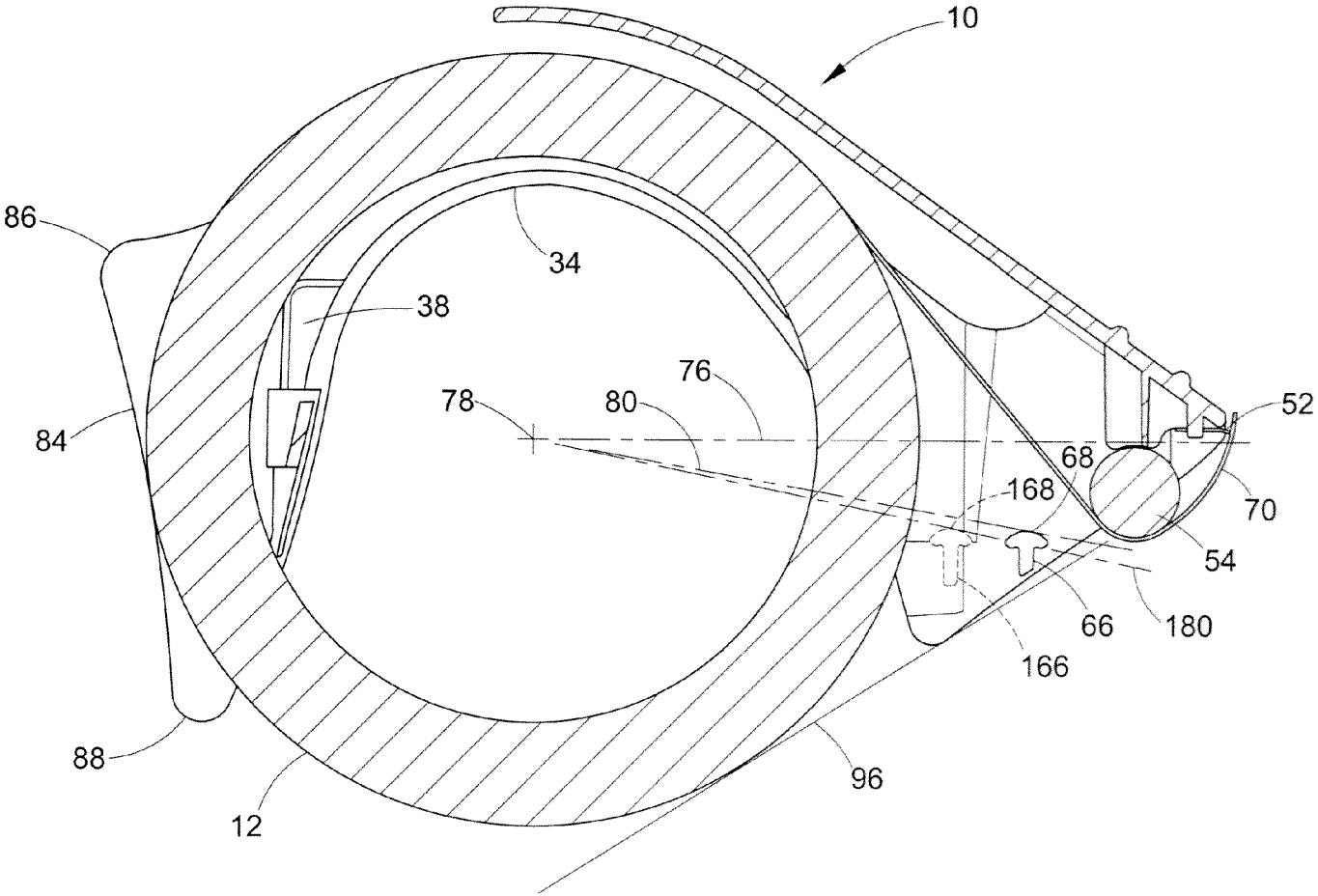
FIG. 5 is a view similar to FIG. 4 rotated 90° and showing the path of tape to be dispensed from the dispenser.

With reference to FIG. 5, the tape dispenser 10 holding a roll of tape 12 is seen in cross section. A length of tape 70 separates from the roll of tape 12 near the top, passes over the tape retaining tab 66 under the roller 54 and adjacent the cutter 52. A length of tape 70 would be in this general configuration directly after a length of tape had been applied to a substrate and cut off. From this state, the length of tape 70 may fall away from the cutter 52 and the roller 54 downwardly into contact with the upper surface 68 of the tape retaining tab 66. Such a length of tape 70 would fall into contact with both the right tape retaining tab 66 and the left tape retaining tab 62. The length of tape 70 would be prevented from falling back upon the roll of tape 12 and held in place. A portion of the length of tape 70 would extend under the roller 54. If the tape user wished to immediately apply a length of tape to a substrate, he need only hold the substrate, for instance a box, in place with one hand while using the other hand to bring the length of tape under the roller 54 into contact with the substrate at the desired location. The roller 54 is pressed down by the user with the hand holding the tape dispenser 10 causing the length of tape 70 to firmly engage the substrate. The tape dispenser 10 is then moved rearwardly, that is to the left in FIG. 5. The roller 54 rotates applying pressure to the length of tape 70 while not pulling the length of tape away from the substrate. This results in the initial length of tape 70 adhering to the substrate and additional tape being pulled off the roll 12 for application to the substrate.

In the past, the starting of a length of tape such as the length 70 onto the substrate often required two hands. If one attempted to simply pull a tape dispenser containing a roll of tape with a tag end along a substrate, the initial portion of the tape would sometimes not adhere to the substrate. User's had to use two hands, one holding the tape dispenser and the other holding the initial length of tape in place on the substrate to get the tape started in application to the substrate. The use of a roller facilitates one handed starting.

The location of the tape retaining tabs 62, 66 and the upper surfaces 64, 68 play a roll in easy starting of a length of tape 70. Keeping the tabs 62, 66 in close proximity to the roller 54, aids in assuring that the length of tape 70 against the roller 54 will properly engage the substrate even if the length of tape 70 is initially adhering to the upper surfaces 64, 68 of the tabs 62, 66.

Still with reference to FIG. 5, a plane (showing as line in this cross section) 76 connects the axis 78 of the roll of tape 12 to the tip of the cutter 54. A second plane 80 connects the axis of the roll of tape 78 to the upper surfaces 68, 64 of the tape retaining tabs, 62, 66. Disposing the upper surfaces 64, 68 of the tape retaining tabs so that the second plane 80 is at an angle of less than about 12° with respect to the first plane 76, provides good cooperation between the tabs and the roller 54. Preferably, this angle should be about 8-12° to provide good cooperation between the tabs and the roller and room for the roller. In the preferred embodiment, the angle between the first plane 76 and the second plane 80 is about 10° and the body of the roller 54 is disposed entirely below the first plane 76.

A second location for the right tape retaining tab 166 with an upper surface 168 is shown dashed in FIG. 5. A second location for the second plane 180 is also shown. If the second location for the tab 168 is used, then the angle between the first plane 76 and the second plane 180 is about 12°.

Figure 2:
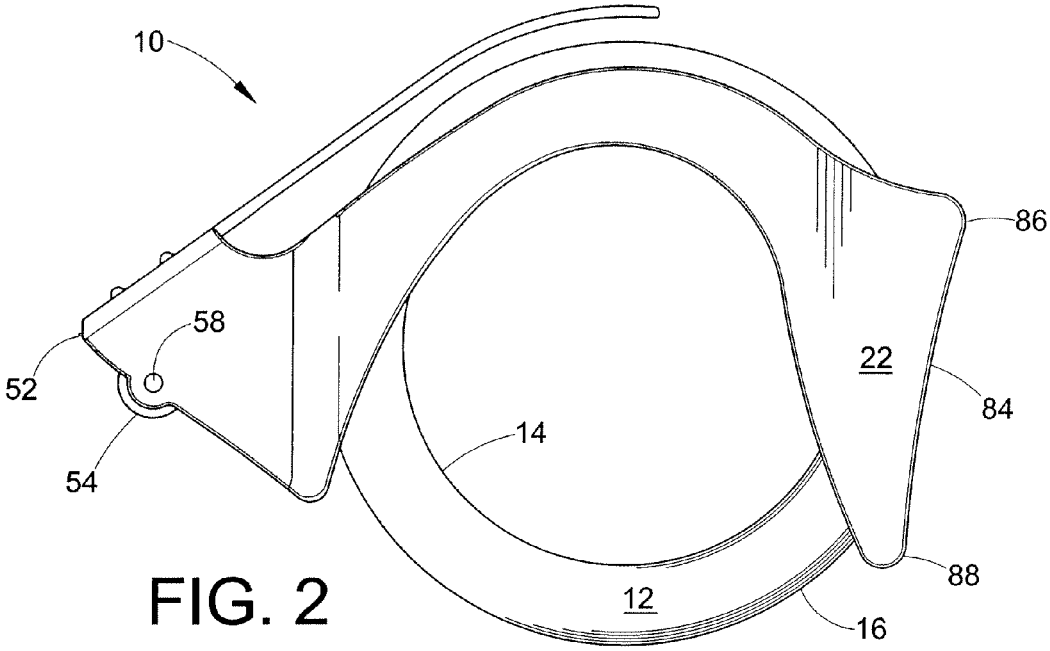
FIG. 2 is a side elevation of the tape dispenser seen in FIG. 1.

With reference once again to FIG. 2, the right sidewall 22 has a foot 84 at its rearward end. The foot is slightly concave with an upper extremity 86 and a lower extremity 88. With respect to the foot, the upper extremity, and the lower extremity, the left sidewall 24 is the mirror image of the right sidewall 22. The tape dispenser 10 may be rested on a horizontal surface in the configuration seen in FIG. 2. However, because the forward end carrying the roller 54 and the cutter 52 is heavier than the foot 84, the forward end will rotate downwardly until the lower extremity of the forward end rests upon the surface or an obstacle on top of the surface. The tape retaining tabs 62, 66 should hold the end of the roll of tape away from the surface upon which the dispenser is resting, but because the end of the roll of tape is close to that surface, there is a possibility that it will engage the surface or some other article resting on the surface and adhere to it unintentionally.

Figure 4:
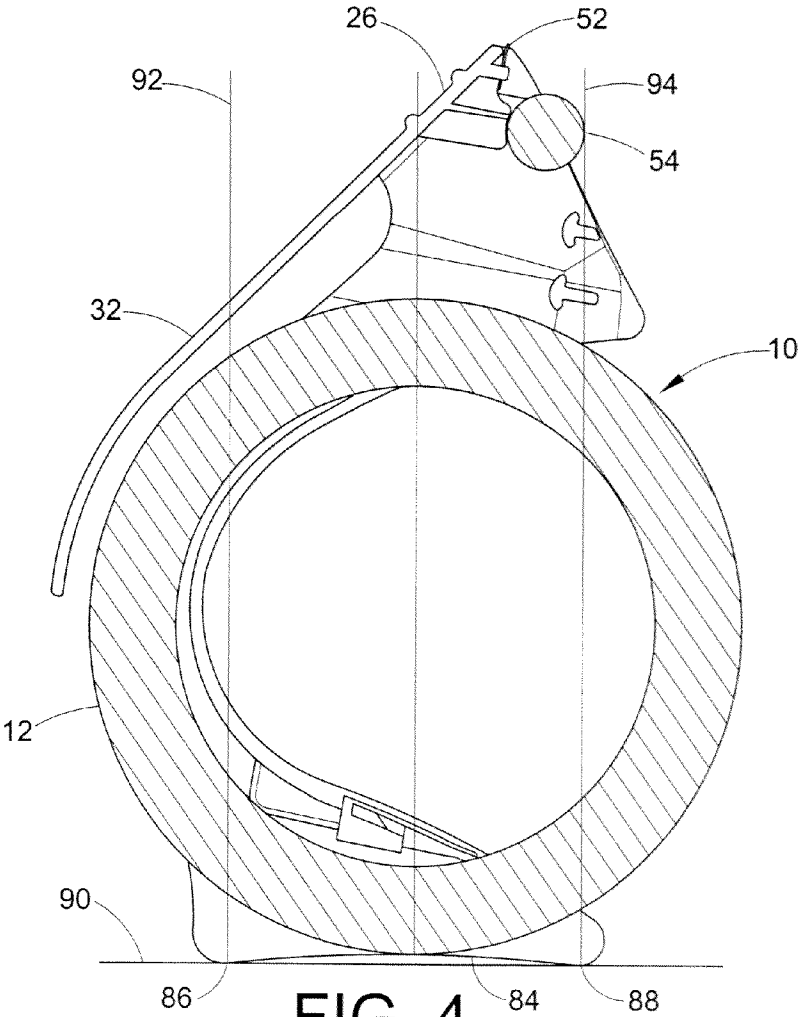
FIG. 4 is a cross section of the tape dispenser taken along 4-4 of FIG. 3 with the dispenser resting on its rear end.

FIG. 4 shows a preferred resting orientation. The tape dispenser 10 rests upon the surface 90 with the foot 84 resting directly upon the surface 90. As previously discussed, the foot 84 is somewhat concave so that the extremities 86, 88 are actually in contact with the surface 90. The extremities 86, 88 of the right sidewall 22 and the left sidewall 24 are aligned as the two sidewalls are mirror images of one another with respect to the feet 84. A third plane 92 passing vertically between the two upper extremities 86 is seen to the left of FIG. 4. A parallel fourth plane 94 passes vertically through the two lower feet extremities 88 vertically. The sidewalls 22, 24 are generally planar and form two additional planes perpendicular to the planes 92, 94. This defines a volume whose lower extremity is bounded by straight lines between the four feet extremities, 86, 88. Mass which is inside of this volume of space, that is between the four lower and upper extremities, 86, 88 is stably supported by the feet 84. Mass which is outside of the volume defined by the plane 92, 94 and the sidewalls 22, 24 may destabilize the dispenser 10 in this position and cause it to tip over. Thus, mass between the planes 92, 94 helps to stabilize the dispenser in its resting "on the foot" position while mass outside of these planes 92, 94 tends to destabilize the dispenser 10 in this position and make it more likely to be knocked over or fall over if the surface 90 is not a horizontal surface. As can be seen in FIG. 4, the tape dispenser 10 holds the roll of tape 12 so that it is mainly within this volume of space and extends beyond the planes 92, 94 in almost equal amounts. More importantly, the forward portions of the tape dispenser including the cutter 52, the roller 54 and the most of the interconnecting portion 26 are all disposed between the planes 92, 94. This aids in the stability of the tape dispenser in this "resting on the foot" configuration. In this resting on the foot configuration, a length of tape supported on the tape retaining tabs, 62, 66 is at considerable distance from the surface 90 upon which the tape dispenser rests. The adhesive underside of this length of tape is protected from unintended engagement with the surface 90. As it will be protected from untended contact with the surface 90 or other objects, the tape is more easily kept clean and on the tabs 62, 66 and ready to be applied in a one handed operation as described above.

In use, a user may pick up the tape dispenser 10 from its standing on the foot configuration, turn the tape dispenser 10 so it assumes the configuration seen in FIG. 5, apply the end of tape 70 to a substrate one handed with the tape dispenser, pull off the desired amount of tape from the roll 12, rotate the tape dispenser so the rear moves upwardly thus bringing a cutter into contact with the length of tape 70 and cutting off the tape. A user may then set the tape dispenser 10 down in the resting on the feet configuration seen in FIG. 4 and either reposition a box or other item to be taped or grasp a second item to be taped and start the process over again. The tape dispenser 10 is stably disposed with the leading end 70 of the tape protected from contact with unintended surfaces and the resting on the foot position. The weight of the roller 54 is directly over the feet and adds to stability.

One handed starting of the tape 70 is facilitated by positioning of the roller 54 so that it protrudes beyond a fifth plane 96 defined by the outside of the roll of tape 12 and the edge of the cutter 52. This allows the roller 54 to engage the length of tape 70 on a substrate and apply a rolling force to the length of tape 70 which leads to initial adhesion. The rolling force applied by the roller 54 has been found to aid in an initial adhesion of the tape 70 to a substrate.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A tape dispenser adapted to dispense tape from a roll of tape on a cylindrical core, said roll of tape having an outer surface and an axis, said tape dispenser comprising:

a first sidewall having a hub structure with a first hub axis, a forward end, a rearward end, a foot adjacent said rearward end;

a second sidewall generally parallel to said first sidewall having a hub structure with a second hub axis generally coaxial with said first hub axis, a forward end, a rearward end, a foot adjacent said rearward end;

an interconnecting portion extending between said first sidewall and said second sidewall and interconnecting said first sidewall and said second sidewall having a forward end adjacent said sidewall forward ends;

a cutter extending between said sidewalls adjacent said interconnecting portion forward end, said cutter having a forward edge generally parallel to said first hub axis;

a generally cylindrical roller extending between said side walls adjacent to said cutter and parallel to said cutter, said roller having an outer surface extending downwardly and outwardly from a first plane tangent to said cutter forward edge and said roll of tape outer surface;

a first tape retaining tab extending from said first sidewall toward said second sidewall, said first tape retaining tab having a first tape engagement surface;

a second tape retaining tab extending from said second sidewall toward said first sidewall and said first tape retaining tab, said second tape retaining tab having a second tape engagement surface extending toward said first tape engagement surface;

wherein a second plane extending from said first hub structure axis to said cutter forward end and a third plane from said first hub structure axis through a line tangent to said first and second tape retaining tab engagement surfaces form an angle of less than about 12 degrees;

wherein said roller positioned entirely between said second plane and said third plane;

said dispenser adapted for one-handed operation;

said one handed operation includes adhering said tape to a substrate, dispensing said tape along said substrate, rotating said dispenser thus bringing said cutter into contact with said tape, and cutting said tape;

said roller and said cutter positioned entirely between a space bordered by a fourth plane and a fifth plane;

said dispenser adapted to rest in a stable condition with said sidewall feet in contact with a planar horizontal surface, said first sidewall foot having a first point of extreme contact and a second point of extreme contact, said second sidewall foot having a third point of extreme contact and a fourth point of extreme contact, and said sidewall forward ends extending upwardly;

wherein said fourth plane connects said first and said third points of extreme contact and extends upwardly when said dispenser rests on said feet; and, wherein said fifth plane connects said second and said fourth points of extreme contact and extends upwardly when said dispenser rests on said feet.

2. The tape dispenser of claim 1 wherein the angle between said second plane and said third plane is about 8 to 12 degrees.

3. A tape dispenser adapted to dispense tape from a roll of tape on a cylindrical core, said roll of tape having an outer surface and an axis, said tape dispenser comprising:

a first sidewall having a hub structure with a first hub axis, a forward end, a rearward end, a foot adjacent said rearward end;

a second sidewall generally parallel to said first sidewall having a hub structure with a second hub axis generally coaxial with said first hub axis, a forward end, a rearward end, a foot adjacent said rearward end;

an interconnecting portion extending between said first sidewall and said second sidewall and interconnecting said first sidewall and said second sidewall having a forward end adjacent said sidewall forward ends;

a cutter extending between said sidewalls adjacent said interconnecting portion forward end, said cutter having a forward edge generally parallel to said first hub axis;

a generally cylindrical roller extending between said side walls adjacent to said cutter and parallel to said cutter, said roller having an outer surface extending downwardly and outwardly from a first plane tangent to said cutter forward edge and said roll of tape outer surface;

a first tape retaining tab extending from said first sidewall toward said second sidewall, said first tape retaining tab having a first tape engagement surface;

a second tape retaining tab extending from said second sidewall toward said first sidewall and said first tape retaining tab, said second tape retaining tab having a second tape engagement surface extending toward said first tape engagement surface wherein a second plane extending from said first hub structure axis to said cutter forward end and a third plane from said first hub structure axis through a line tangent to said first and second tape retaining tab engagement surfaces form an angle of less than about 12 degrees;

said dispenser adapted to rest in a stable condition with said sidewall feet in contact with a planar horizontal surface, said first sidewall foot having a first point of extreme contact and a second point of extreme contact, said second sidewall foot having a third point of extreme contact and a fourth point of extreme contact, and said sidewall forward ends extending upwardly;

said roller, said cutter, and said tabs being within a volume of space bordered by lines extending upwardly from said first, second, third and fourth points of extreme contact when said dispenser rests on said feet;

said dispenser in said stable condition positions a majority of the mass of said dispenser within said volume of space;

said dispenser adapted for one-handed operation; and, said one-handed operation includes adhering said tape to a substrate, dispensing said tape along said substrate, cutting said tape, and resting said dispenser on said sidewall feet;

said roller and said cutter positioned entirely between a space bordered by a fourth plane and a fifth plane;

wherein said fourth plane connects said first and said third points of extreme contact and extends upwardly when said dispenser rests on said feet; and, wherein said fifth plane connects said second and said fourth points of extreme contact and extends upwardly when said dispenser rests on said feet; and, wherein said roller is proximal to said fifth plane and distal to said fourth plane.

4. The tape dispenser of claim 3 wherein the angle between said second plane and said third plane is about 8 to 12 degrees.

* * * * *